United States Patent [19]

Scott

[11] Patent Number: 4,497,099

[45] Date of Patent: Feb. 5, 1985

[54] METHOD FOR PRODUCTION OF SYNTHETIC YARN AND YARN-LIKE STRUCTURES

[75] Inventor: Alexander Scott, Paisley, Scotland

[73] Assignee: J & P Coats, Limited, Glasgow, Scotland

[21] Appl. No.: 339,888

[22] Filed: Jan. 18, 1982

[30] Foreign Application Priority Data

Feb. 4, 1981 [GB] United Kingdom ..... 8103461

[51] Int. Cl.[3] ..... D02G 1/16; D02G 1/18

[52] U.S. Cl. ..... 28/220; 28/254; 28/273; 57/6; 57/350

[58] Field of Search ..... 57/6, 350, 207, 208; 28/220, 254, 252, 273

[56] References Cited

U.S. PATENT DOCUMENTS

| | | | |
|---|---|---|---|
| 3,199,281 | 8/1965 | Maerov et al. | 57/208 X |
| 3,438,193 | 4/1969 | Kosaka et al. | 57/6 X |
| 3,780,515 | 12/1973 | Waters | 57/6 |
| 3,812,668 | 5/1974 | Wilson | 57/6 |
| 3,971,202 | 7/1976 | Windley | 28/220 X |
| 4,069,657 | 1/1978 | Bascom et al. | 57/6 |
| 4,319,447 | 3/1982 | Barron | 57/6 |
| 4,343,071 | 8/1982 | Schroder | 28/254 X |

*Primary Examiner*—Robert R. Mackey
*Attorney, Agent, or Firm*—William R. Hinds

[57] ABSTRACT

Synthetic yarn and yarn-like structures are formed by the method of treating separate strands of thermoplastic material so that at least one has a shrinkage ratio higher than normal at an elevated temperature. The strands are fed forwardly at different rates of overfeed and intermingled in a gas stream with formation of loops on the strands, then heated to cause them to shrink differentially while being held to a predetermined length until shrinkage ceases. Apparatus for performing the method includes yarn drawing means, intermingling means comprising a jet device incorporating intersecting passages for the strands and for a gas under pressure, feeding means and heating and cooling means for the intermingled yarn downstream from the jet device, also means for holding the intermingled yarn to a predetermined length while it is being heated and cooled. Yarn produced by the method incorporates filaments at least some of which present bud-like projections inhibiting relative movement of the filaments.

6 Claims, 3 Drawing Figures

METHOD FOR PRODUCTION OF SYNTHETIC YARN AND YARN-LIKE STRUCTURES

FIELD OF THE INVENTON

The subject of this invention is a synthetic yarn and particularly a substantially twistless multifilament synthetic yarn and a method and apparatus for manufacturing the yarn. In the following description the word "yarn" is used in its broadest textile sense and also as including all yarn-like structures. It is to be understood as including doubled yarns such as sewing thread as well asyarns of all types for making up into woven and knitted structures. It is also to be understood as including structures of yarn-like form including strings, twines and ropes.

BACKGROUND

It is known to manufacture yarns formed of a number of plies, each of which may be composed of a number of filaments twisted together to provide a yarn of the desired linear density. The twisting action is performed to cause the filaments making up the yarn to form an integrated structure with definite diametral dimensions and with a substantially smooth exterior surface. The operations necessary to form such a twisted structure require the use of multiple processes with their attendant proneness to manufacturing faults with the result that twisted yarn is comparatively time consuming to produce and requires close quality control.

Because of the advantages associated with twistless yarn many attempts have been made to produce such a yarn, the most common method being to cause the elements of the yarn to adhere to one another by the introduction of adhesive in some form. This is sometimes done by putting blobs of material having adhesive properties at elevated temperature along all or selected elements of the yarn then heating the yarn to cause the adhesive to melt and attach itself to the adjoining elements. Another method has been to form one of the elements of a low melting point material and after bringing the appropriate number of elements together to heat the yarn thus formed whereupon the strand of low melting point material melts and acts as an adhesive holding the other strands together. In all these methods while they have produced twistless yarns, the yarns all suffer from the disadvantage that because of the comparatively large quantity of adhesive or low melting point material which must be employed to provide adequate cohesion they tend to be stiff. This is because of the inability of the yarn elements to slide over one another when the yarn is bent. In other words, the yarn tends to act as a solid bar rather than as a laminated structure.

It would be a great advance in the art if there could be produced a flexible twistless yarn with none of its known disadvantages and it is an object of the present invention to provide such a yarn and also to provide a method and apparatus for the production of such a yarn.

FEATURES AND ASPECTS OF THE INVENTION

A method of producing a substantially twistless yarn from at least two separate strands of thermoplastic strand material according to the invention comprises treating at least one strand to cause it to have a shrinkage ratio higher than normal at an elevated temperature for the particular material of the strand, subjecting the strands to a turbulent stream of fluid while feeding them forwardly at different rates of feed so that loops form on the strands and they become intermingled whereby they form an intermingled yarn, heating successive quanta of the intermingled yarn to a temperature sufficient to cause the strands to shrink differentially while holding each quantum of intermingled yarn to a predetermined length and cooling each said quantum to a temperature below that at which shrinkage ceases while the predetermined length is maintained.

The fluid may be liquid or gaseous.

The treatment to cause a strand to have a higher shrinkage ratio than normal may be a drawing treatment consisting of subjecting the strand to a ratio of draw greater than normal for the particular material of the strand with or without a heat treatment.

The ratio of draw may be at least 15% greater than normal for the particular material of the strand.

The heating and cooling are preferably performed as continuous operations.

Each strand may comprise a number of filaments and may have some initial degree of twist.

The process may be operated using only two strands but three or more strands are preferred, with at least one strand treated to cause it to have a shrinkage ratio higher than normal for the material of the strand.

The strand material may be, for example, polyester or polyamide and may be received drawn to a ratio less than the normal drawing ratio for that material.

It has been found that where the normal draw ratio for a particular yarn material is 1:1.7, a ratio of 1:2.2 provides a sufficient degree of drawing. An object of a drawing ratio such as this is to increase the shrinkage at temperatures in excess of 180° C. In the case of polyester yarn, a desirable shrinkage ratio for strand material used in the process lies in the range 12% to 18%.

Apparatus for performing the process may comprise drawing means for drawing the initial strand material to a chosen ratio of draw, intermingling means for bringing the yarn elements together and forming an intermingled yarn, feeding means arranged to feed the yarn to the intermingling means at different rates of overfeed with respect to the rate at which yarn leaves the intermingling means, heating means for applying heat to the intermingled yarn, means for holding successive quanta of intermingled yarn to a predetermined length while the heat is being applied by the heating means and while cooling of the yarn is taking place and means for removing the yarn continuously from the heating means.

The intermingling means may comprise a jet device having a passage for yarn and a passage for entry of fluid, the passages meeting with one another in such a way that the fluid forms a turbulent stream which impinges on and carries the yarn forwardly while doubling the filaments over on themselves to form loops.

The jet device may include a barrier disposed to be impacted by the fluid after it has met the yarn. The jet device may incorporate means for varying the relationship of the yarn and fluid passages between two extreme position in one of which the jet is operable as an aspirating jet i.e. a jet producing a suction at the yarn entry end and another in which the jet is operable solely as a driving jet i.e. a jet capable of moving the yarn forwardly with little or no aspiration. Jets capable of performing in this fashion are well known.

The means for feeding the strands may be feed rollers arranged to be driven at different peripheral speeds.

The means for imparting heat to the intermingled yarn and for holding successive quanta of the intermingled yarn at a predetermined length as a continuous operation may comprise at least one heated roller around which the yarn is led. The heated roller may be a grooved roller operating in conjunction with a separator roll, the yarn being led from one groove to another on the heated roller around the separator roll.

The invention also resides in the provision of a yarn formed by the process of the invention, said yarn comprising at least two multifilament strands intermingled with one another, the filaments of at least one strand presenting a series of bud-like projections constituted by tightened loops which inhibit relative movement of the filaments and the resultant yarn providing a unit structure in which the strands are not individually distinguishable as such.

Several yarns of the invention may be laid together e.g. by twisting to form a plied yarn and several plied yarns according to the invention may be laid together to form a cabled yarn.

A plying operation and /or a cabling operation employing yarns according to the invention may be performed by a known method.

DESCRIPTION OF THE DRAWINGS

A practical embodiment of apparatus according to the invention is illustrated in the accompanying semi-diagrammatic drawing designated as FIG. 1. The apparatus is shown as making a yarn from three strands. Other numbers of strands may be employed, the only difference in the apparatus being a corresponding change in the number of feed and draw rollers. A length of yarn in the form in which it leaves the jet device is illustrated to a greatly enlarged scale in FIG. 2, and the length of yarn in its finished state is illustrated to a greatly enlarged scale in FIG. 3. For simplicity of illustration the strands are shown as each comprising a single filament.

DESCRIPTION OF PREFERRED EMBODIMENTS

Figure 1:
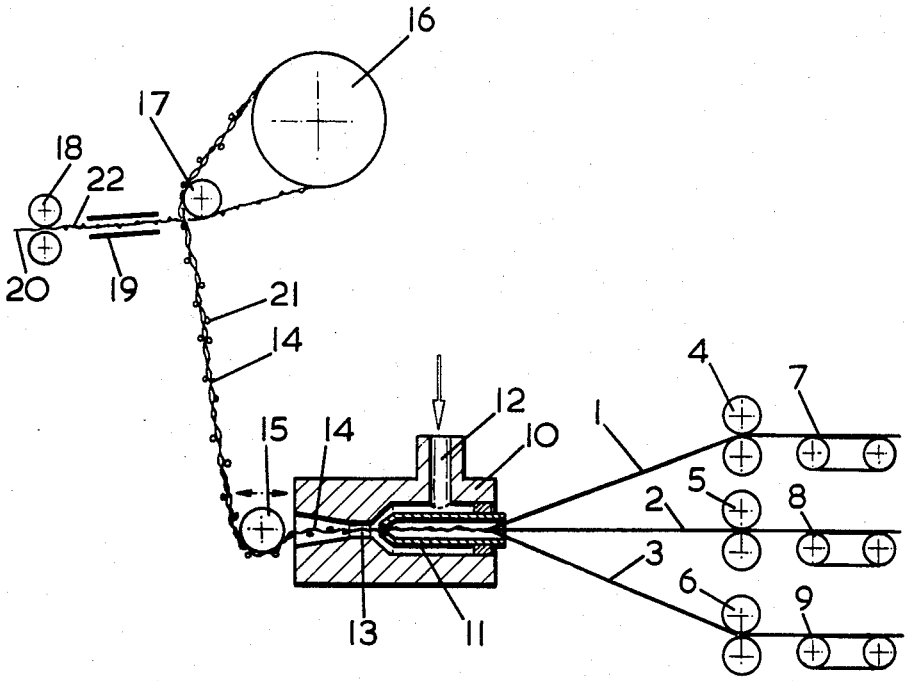
Figure 2:
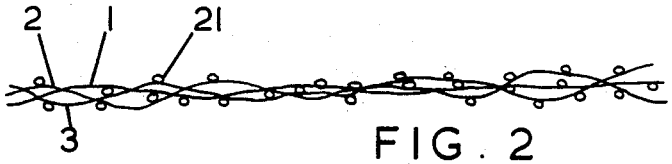
Figure 3:
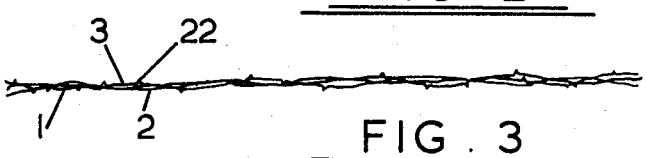

In the drawings and referring first to FIG. 1, 2 and 3 denote different strands, 4, 5 and 6 denote respective sets of feed rollers for the strands arranged to feed the strands forwardly at different rates of feed, the feed rollers for one strand, for example 1, being preferably arranged to feed at a rate which is lower than that of the other strands and may be only slightly above the take-off speed and the feed rollers for the other strands 2 and 3 being arranged to feed the strands 2 and 3 at rates considerably above the take-off speed although different from one another. 7, 8 and 9 denote draw rollers. A suitable drawing ratio for the strands 2 and 3 is that sufficient to provide a drawing ratio around 50% higher than normal. The ratio of drawing gives high shrinkage characteristics to the strands. 10 denotes intermingling means constituted by a jet device having a passage 11 arranged to receive the strands 1, 2 and 3 coming from the feed rollers and 12 denotes an inlet passage for a fluid at a temperature below the plasticization temperature of the strand material. The position of the passage 11 is variable in the body of the jet device 10. This permits the jet device to be set to perform as an aspirating jet providing a suction in the passage 11 for stringing-up purposes i.e. to feed the ends of the strands through the jet device or to be set to become a driving jet feeding the strands forwardly. Numeral 13 denotes a mixing zone where the fluid meets the yarn and causes the yarn elements to intermingle with one another to produce an intermingled yarn 14. Numeral 15 denotes a barrier which is movable towards and from the body of the jet device. The barrier has a beneficial effect on operation of the jet device. Numeral 16 denotes a heating roller and 17 denotes a separator roller. Numeral 18 denotes nip rollers, the function of which is to hold the quantum of yarn located between the separator roller 17 and the nip rollers 18 against further shrinkage while the shrunk yarn is being cooled in a cooling zone 19 to a temperature at which further shrinkage cannot take place. 20 denotes finished yarn on its way to the winding apparatus.

In FIG. 2, the strands are illustrated as they leave the jet device. The strands are doubled back on one another at intervals to form loops 21. FIG. 3 illustrates the yarn in its final form after differential shrinkage of the strands has taken place. 22 denotes the bud-like projections formed as the loops 21 have been pulled tight as the strands shrink.

In operation of the embodiment described, the strands 1, 2 and 3 leave the drawing rollers 7, 8 and 9 with the strands 2 and 3 in a state of high shrinkage characteristics, then enter the passage 11 together still separate from one another and with different rates of overfeed and by the driving action of the jet device 10 are moved through the mixing zone 13 in which the fluid entering by the passage 12 causes the strands to intermingle with one another and with the filaments formed at close intervals into loops 21 by the action of the jet device 10. The intermingled yarn 14 thus formed leaves the jet device 10 at a speed lower than the speed of entry of all the entering strands and passes by way of the barrier to the heating roller 16 and the separator roller 17. In its passage around these rollers, each quantum of yarn in convoluted form on the rollers 16 and 17 is held at a predetermined length while being heated by the roller 16. The intermingled strands 1, 2 and 3 attempt to shrink each according to its shrinkage characteristics but being held to the predetermined length on the rollers 16 and 17, they collapse on one another by reason of the tensile stresses generated in them which cause the intermingled filaments to tend to contract. This action causes the loops 21 to tighten and form the bud-like projections 22 on the strands. The shrunk yarn when it finally leaves the heating roller 16 passes through the cooling zone 19 to the nip rollers 18. The nip rollers 18 hold the quantum of shrunk yarn between the roller 17 and the rollers 18 against further shrinkage while it is cooled in the cooling zone 19 to a temperature at which shrinkage cannot take place. The yarn 20 leaving the nip rollers 18 is now in a fully stable condition. During shrinkage, the projections 22 on the different strands interact with one another and lock together. The strand 1 which has shrunk to the least extent tends to become a core strand with the other strands clustered around it.

The finished yarn shows no tendency to separate into its elements although without twist, it is substantially uniform in cross section and has an acceptable degree of flexibility because despite entanglement of the individual bud-like projections the strands which are now individually indistinguishable as such are still able to move to some extent relatively to one another. The method requires the minimum of operations and quality control and can operate as a continuous process.

A practical example of performance of the process is given below:

Three separate polyester multi-filament yarns of 167 d'tex (150 denier) were subjected to a degree of drawing such that they had residual shrinkages in the range 12% to 18% when measured at 150° C. Using the apparatus illustrated in the drawing and as described above, the strands were combined to give an intermingled structure. Strands 2 and 3 were fed into the jet device at speeds respectively 7.5% and 18% higher than that of strand 1 which was fed into the jet at a speed 4% higher than that at which the intermingled strands left the jet device.

On leaving the jet device, the integrated structure of intermingled strands was passed around the roller system heated to a temperature somewhat in excess of 180° C. which caused the strands to shrink differentially and lock together with the strands 2 and 3 clustered around the strand 1. This structure was then cooled and the locked yarn was now in a stable state such that it was suitable for use as a general purpose sewing thread. In this example, the speed of the thread leaving the apparatus was 150 m/minute.

The finished yarn was flexible, uniform in cross section and was stable with no tendency of the strands to separate from one another.

I claim:

1. A method of producing a substantially twistless intermingled composite yarn from at least two separate strands of thermoplastic strand material comprising drawing at least one strand by an amount such that the ratio of draw and hence the shrinkage ratio are increased to relatively high values for the particular material of which the strand is made, subjecting the strands to a turbulent stream of fluid while feeding them forwardly at different rates of overfeed so that loops form on the strands, thus creating an intermingled textured yarn, and then heating the intermingled yarn, which heating step incorporates the steps of holding successive quanta of the yarn to a predetermined length while the yarn is being heated thus causing the loops to pull tight into the form of bud-like projections and the strands to collapse on one another so that the previously textured form of the yarn is eliminated and the bud-like projections on the different strands entangle with one another and restrict relative movement of the strands, then continuing to hold the now untextured yarn against shrinkage and at the same time cooling it to a temperature below that at which the yarn ceases all attempt to shrink further and the yarn remains completely stable as an untextured yarn.

2. A method as claimed in claim 1, in which the ratio of draw is at least 15% greater than normal for the particular material of the strand.

3. A method as claimed in claim 1 in which each strand comprises a number of filaments.

4. A method as claimed in claim 1 wherein the shrinkage ratio for said at least one strand is in the range of about 12% to 18%.

5. A method as claimed in claim 4 wherein the shrinkage ratio of each of said strands is in the range of about 12% to 18%, with at least one of said strands having a shrinkage ratio lower than the other strand.

6. A method as claimed in claim 5 wherein said strand of a lower shrinkage ratio is fed at a lower rate of overfeed than the other strand.

* * * * *